United States Patent [19]

Stapp

[11] Patent Number: 4,724,068

[45] Date of Patent: Feb. 9, 1988

[54] HYDROFINING OF OILS

[75] Inventor: Paul R. Stapp, Bartlesville, Okla.

[73] Assignee: Phillips Petroleum Company, Bartlesville, Okla.

[21] Appl. No.: 886,482

[22] Filed: Jul. 17, 1986

[51] Int. Cl.[4] ..... C10G 45/00; C10G 45/06

[52] U.S. Cl. ..... 208/213; 208/215; 208/217; 208/209; 208/107; 208/251 H; 208/254 H; 208/108

[58] Field of Search ..... 208/251 H, 254 H, 209, 208/107, 215, 213, 217

[56] References Cited

U.S. PATENT DOCUMENTS

| | | | |
|---|---|---|---|
| 2,394,751 | 2/1946 | Cole | 208/215 |
| 3,081,258 | 3/1963 | Van Dongen et al. | 208/217 |
| 3,219,620 | 11/1965 | Fear | 208/14 |
| 3,271,302 | 9/1966 | Gleim | 208/251 H |
| 3,622,502 | 11/1971 | Mason et al. | 208/112 |
| 3,704,108 | 11/1972 | Alpert | 44/62 |
| 3,856,664 | 12/1974 | Whitehurst | 208/252 |
| 4,070,272 | 1/1978 | Rausch | 208/217 |
| 4,089,773 | 5/1978 | Espenscheid | 208/8 |
| 4,143,086 | 3/1979 | Carle et al. | 260/683 PD |
| 4,430,206 | 2/1984 | Rankel | 208/251 H |
| 4,465,584 | 8/1984 | Effron et al. | 208/107 |

FOREIGN PATENT DOCUMENTS

| | | | |
|---|---|---|---|
| 2125779 | 3/1984 | United Kingdom | 423/220 |

*Primary Examiner*—Andrew H. Metz
*Assistant Examiner*—Helane Myers
*Attorney, Agent, or Firm*—K. K. Brandes

[57] ABSTRACT

A hydrocarbon-containing feed stream, e.g., a heavy oil or residuum, is contacted under suitable reaction conditions with free hydrogen, hydrogen sulfide and at least one olefin polymer, preferably polypropylene or polystyrene, so as to produce a hydrocarbon product stream having increased $API_{60}$ gravity and lower content of heavies. Generally, the amounts of impurities (sulfur, nitrogen, nickel and vanadium) contained in the feed stream are reduced in this hydrotreating process.

20 Claims, No Drawings

HYDROFINING OF OILS

BACKGROUND OF THE INVENTION

This invention relates to an improved process for hydrotreating hydrocarbon-containing feed streams, especially heavy oils. In another aspect, this invention relates to the use of a polymeric treating agent for upgrading heavy oils.

Many liquid hydrocarbon-containing streams such as heavy crude oils, heavy residua, products from extraction and/or liquefaction of coal and lignite, products from tar sands and shale oil contain sulfur, metals, coke precursors and materials boiling in excess of 1,000° F. (at 1 atm). The presence of these impurities makes further processing of heavier fractions difficult since they generally cause the deactivation of catalysts employed in processes such as catalytic hydrogenation and hydrocracking. Heavy oils are also quite viscous due to the high content of high molecular weight carbonaceous materials called heavies, and it is thus difficult to transport these heavy oils through pipelines.

It is well known to hydrotreat (hydrofine) liquid hydrocarbon-containing feed streams such as heavy oils, which contain undesirable metal and sulfur compounds as impurities and also considerable amounts of cokable materials and heavies, so as to convert them to lower boiling materials having lower molecular weight and lower viscosity than the feed hydrocarbons and to remove at least a portion of metal and sulfur impurities. A specific type of hydrotreating process is heat-soaking, preferably with agitation, in the presence of hydrogen but preferably in the absence of a solid, inorganic catalyst, hereinafter referred to as hydrovisbreaking. There is an ever present need to improve such hydrovisbreaking processes utilizing more efficient and/or less expensive hydrotreating agents than those presently employed.

SUMMARY OF THE INVENTION

It is thus an object of this invention to provide a process for increasing the API gravity of substantially liquid hydrocarbon-containing feed streams and thus to improve the flowability and processability of these streams. It is another object of the invention to provide a process for reducing the amount of hydrocarbons boiling in excess of 1,000° F. (at 1 atm). It is still another object of this invention to provide a process for reducing the amount of metal, sulfur and nitrogen impurities contained in these hydrocarbon-containing feed streams. It is a still further object of this invention to employ an effective agent for hydrotreating hydrocarbon-containing feed streams. Other objects and advantages will be apparent from the detailed description and the appended claims.

In accordance with this invention, an upgrading process is provided comprising the step of contacting (a) a substantially liquid hydrocarbon-containing feed stream substantially simultaneously with (b) free hydrogen, (c) hydrogen sulfide and (d) at least one polymer selected from the group consisting of homopolymers and copolymers of olefinic monomers, in the substantial absence of a solid, inorganic cracking catalyst and a solid, inorganic hydroconversion catalyst, under such contacting conditions as to obtain a product stream having higher $API_{60}$ gravity and having lower content of hydrocarbons boiling above 1,000° F. (at atmospheric pressure, about 1 atm) than the feed stream; wherein the general formula of said olefinic monomers is

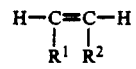

with $R^1$ being selected from H, alkyl groups having from 1 to 6 carbon atoms, alkenyl groups having from 2 to 6 carbon atoms cycloalkyl groups having from 5 to 10 carbon atoms, aryl groups having from 6 to 12 carbon atoms, the —OH group, —$OR^3$ groups with $R^3$ being an alkyl radical having from 1–3 carbon atoms, the —COOH group, —$COOR^3$ group with $R^3$ as defined above, the —CN group and the —$CONH_2$ group, and $R^2$ being selected from the same group as $R^1$ except that H is not included.

Presently preferred polymers are polypropylene, which can be substantially crystalline or amorphous, and polystyrene, more preferably normally solid polypropylene and polystyrene (in particular scrap polypropylene and polystyrene). Presently most preferred is normally solid polystyrene.

DETAILED DESCRIPTION OF THE INVENTION

The term "substantially liquid hydrocarbon-containing feed stream" as used herein means that the feed stream is predominantly present in the liquid phase at the contacting conditions of the process of this invention. The term "normally solid polymer" as used herein means that the polymer is solid at ambient conditions, i.e., about 25° C. and 1 atm, and includes substantially resinous and substantially elastomeric (rubbery) polymers. The term "normally liquid polymer" means that the polymer is a low molecular weight oligomer, which is a viscous liquid at ambient conditions. The term "ppm" as used herein means parts by weight (e.g. of Ni or V) per million parts by weight of feed stream.

Any hydrocarbon-containing feed stream that is substantially liquid at the contacting conditions of the process of this invention and contains hydrocarbons boiling in excess of 1,000° F. can be processed in accordance with the present invention. Suitable hydrocarbon-containing feed streams include crude oil, petroleum fractions, coal pyrolyzates, products from coal liquid fraction, products from solvent extraction of coal and lignite, products from tar sand, shale oil, shale oil fractions and similar products. Preferred hydrocarbon-containing feed streams include full range (untopped) crudes, topped crudes having an initial boiling point in excess of about 343° C., and vacuum resids. The present invention is particularly directed to heavy feed streams such as heavy full range crudes, heavy topped crudes, residua and other materials which are generally regarded as too heavy to be distilled. These materials will generally contain the highest concentrations of Ramsbottom carbon residue, metals (Ni, V), sulfur and nitrogen.

Typically the feedstocks employed will consist primarily of hydrocarbons and will have an $API_{60}$ gravity (i.e., API gravity measured at 60° F.) in the range of about 1 to about 30, particularly about 4 to about 20. Generally these feedstocks contain from about 0.2 to about 12 (preferably about 1–6) weight-% sulfur, about 0.1 to about 40 weight-% Ramsbottom carbon residue (as determined by ASTM D524), about 5 to about 2,000 (preferably about 10–1,000) ppm vanadium, about 3 to about 1000 (preferably about 5–500) ppm nickel, and about 0.1 to about 3 (preferably about 0.2–2) weight-% nitrogen. The amount of heavies boiling over 1,000° F. (at 1 atm pressure) generally is in the range of from about 1 to about 100 weight-%, in particular from about 20 to about 90 weight-%.

The olefinic polymers that can be employed of this invention can be normally solid polymers or normally liquid polymers. Non-limiting examples of the polymers that can be employed in the process of this invention are homopolymers and copolymers of propylene (such as polypropylene and ethylene-propylene copolymers), homopolymers and copolymers of 2-methylpropylene, homopolymers and copolymers of 2-methyl-1-butene, homopolymers and copolymers of 2-methyl-2-butene, homopolymers and copolymers of 2-methyl-1-pentene, 2-methyl-2-pentene, homopolymers and copolymers of 3-methyl-2-pentene, homopolymers and copolymers of 1,3-butadiene, homopolymers and copolymers of isoprene, homopolymers and copolymers of styrene (such as resinous polystyrene and butadiene-styrene copolymers), and homopolymers and copolymers of alpha-methylstyrene, homopolymers and copolymers of divinylbenzene, homopolymers and copolymers of tolylethylene, homopolymers and copolymers of acrylic acid and esters (such as methyl or ethyl esters) thereof, homopolymers and copolymers of methacrylic acid and esters thereof, homopolymers and copolymers of vinylalcohol, homopolymers and copolymers of vinylethers, and homopolymers and copolymers of acrylonitrile, homopolymers and copolymers of acrylamide and methacrylamide.

Presently, preferred polymers are homo- and copolymers of propylene having a weight average molecular weight in the range of from about 1,000 to about $1\times10^6$ and homo- and copolymers of styrene having a weight average molecular weight in the range of from about 2,000 to about $2\times10^6$. The presently more preferred polymer materials used in the process of this invention are polypropylene and polystyrene, most preferably normally solid polystyrene. These polymer materials, if solid, can be cut, shredded or ground to a suitable particle size before being added to the reactor in which the hydrovisbreaking process occurs. The particle size of normally solid polymer material should be such that it can be suspended in the hydrocarbon-containing feed stream when being agitated. More preferably, the polymer is in powder form.

Gases employed in the process of this invention are molecular hydrogen and hydrogen sulfide. Preferably, these two gases are substantially pure gases. But they can be admixed with other gases such as methane, nitrogen, carbon monoxide, carbon dioxide. Hydrogen and hydrogen sulfide can be introduced as two separate streams into the hydrovisbreaking reactor; or they can be premixed and then introduced as one stream. The volume ratio of $H_2$ to $H_2S$ (measured at 25° C., 1 atm), regardless of whether both gases are introduced in separate streams or as a mixture, can be in the range of from about 0.01:1 to about 200:1, and is preferably in the range of from about 0.1:1 to about 20:1, more preferably in the range of from about 0.5:1 to about 10:1.

Any apparatus which will afford an intimate contact of the hydrocarbon-containing feed stream with free hydrogen, hydrogen sulfide and olefin polymer at elevated temperature conditions can be employed. The process is in no way limited to the use of a particular apparatus. The process can be carried out in a batch process, e.g., in an autoclave which can be heated and pressured with hydrogen and hydrogen sulfide and which is preferably equipped with internal agitating means or circulating pumping means. Or the process can be employed as a continuous process, e.g., in a tubular reactor through which at least partially mixed streams of hydrocarbon-containing feed, olefin polymer, free hydrogen and hydrogen sulfide flow. The tubular reactor is equipped with heating means and can have static mixing means for enhanced treating efficiency. Or the continuous process can be conducted in an autoclave, equipped with heating and mixing means, with one or more inlet for the hydrocarbon-containing feed stream, polymer compound, free hydrogen and hydrogen sulfide and with outlets for off-gases and the treated product stream, generally located above said inlets. The term hydrocarbon-containing feed stream is used herein to refer to both a continuous and a batch process. Optionally, olefin polymer particles can be premixed with the hydrocarbon-containing feed stream before their introduction into the reactor. Also, optionally, the two employed gases, $H_2$ and $H_2S$, can also be premixed and introduced as a combined gaseous stream into the reactor.

The upgrading process of this invention can be carried out at any suitable temperature that will afford an increase in API gravity of the hydrocarbon-containing feed stream. Generally the reaction temperature ranges from about 250° C. to about 550° C., preferably from about 300° C. to about 500° C., more preferably from about 350° C. to about 450° C. Higher temperatures than 550° C. may improve the removal of sulfur and metal impurities but may have adverse effects such as more coke formation, and may also not be desirable for economic reasons.

Any suitable ratio of the added olefin polymer to the hydrocarbon-containing feed can be employed. The weight ratio of olefin polymer to hydrocarbon-containing feed generally is in the range of from about 0.01:1 to about 5:1, preferably from about 0.02:1 to about 1:1, more preferably from about 0.05:1 to about 0.5:1.

Any suitable pressure can be utilized in the upgrading process of this invention. The pressure should be high enough to keep a substantial portion of the hydrocarbon feed in the liquid state. The reaction pressure can range from about atmospheric to an economically practical pressure as high as 20,000 psig. Generally the total gas pressure (i.e., essentially the pressure of $H_2$ plus $H_2S$) ranges from about 100 psig to about 10,000 psig, preferably from about 400 psig to about 5,000 psig.

It is within the scope of this invention to dilute the hydrocarbon-containing feed stream with a suitable, essentially inert solvent such as a high boiling paraffin (e.g., kerosene or light gas oil) before it is contacted with the olefin polymer, free hydrogen and hydrogen sulfide. It is also within the scope of this invention, yet presently not preferred, to disperse in said feed stream inert inorganic materials such as alumina, aluminum phosphate and silica. It is, however, not contemplated to use in the process of this invention a solid, inorganic hydroconversion (i.e., hydrocracking, hydrotreating, hydrogenation) catalyst, generally promoted with metals or compounds thereof (e.g. alumina-supported molybdenum oxides or nickel oxides or cobalt oxides which may have been presulfided). It is also not contemplated to employ any substantial amount (i.e., any amounts higher than traces) of particulate cracking catalysts such as zeolites and clays in the process of this invention. It is within the scope of this invention (but presently not preferred) to dissolve in said feed stream a decomposable transition metal compound, such as molybdenum hexacarbonyl, molybdenum dithiocarbamate and molybdenum dithiophosphate, during the hydrotreating process of this invention, optionally in the presence of the dispersed hydrotreating catalyst described immediately above.

Any suitable reaction time, i.e., the time of intimate, simultaneous contact of the hydrocarbon-containing feed stream, solid olefin polymer, hydrogen and hydrogen sulfide, under such conditions as will result in a reduced level of heavies and an increase of $API_{60}$ gravity, can be selected. In a continuous process, the flow rates of the hydrocarbon-containing feed stream and of the treating gases are adjusted such as to provide the desired reaction time. The actual reaction time will greatly depend on the selection of an effective, yet safe reaction temperature and on the desired degree of reduction of heavies and $API_{60}$ gravity increase. Generally, the reaction time ranges from about 1 minute to about 30 hours, more preferably from about 0.5 to about 10 hours.

In the process of this invention, impurities contained in the hydrocarbon-containing feed stream (primarily coke precursors, vanadium and nickel) are at least partially converted to a "sludge", i.e., a precipitate of metals and coke, dispersed in the liquid portion of the hydrocarbon containing product stream. The separation of this precipitate and of dispersed olefin polymers from the liquid potion of the hydrocarbon-containing product stream having an increased $API_{60}$ gravity and lower content of heavies can be carried out by any suitable separation means such as distillation, filtration, centrifugation, or settling and subsequent draining of the liquid phase.

In accordance with a further embodiment, at least a part of the liquid portion of the hydrocarbon-containing stream having increased $API_{60}$ gravity and lower heavies content is separated into various fractions by distillation, optionally under vacuum conditions. The light fractions, e.g., those boiling up to 400° F. at atmospheric pressure, can be used as automotive or aircraft fuels or as refining feedstocks. At least one of the heavy fractions, e.g., those boiling above 400° F. at atmospheric pressure, is frequently catalytically hydrotreated for further purification such as in hydrodesulfurization and/or hydrodenitrogenation operations employing well known solid hydrotreating catalysts. Examples of such catalysts are alumina-supported transition metal compounds (e.g., compounds of Mo, Co and Ni), which can be employed in slurry-type or fixed bed operations so as to further reduce the level of sulfur and other impurities in said fraction.

In still another embodiment, the thus catalytically hydrotreated hydrocarbon-containing fraction is catalytically cracked, such as in a fluidized catalytic cracking process employing zeolite or other well known cracking catalysts, so as to convert at least a portion of said fraction to hydrocarbons having lower molecular weight and lower boiling point (preferably gasoline and diesel fuel). If the hydrocarbon-containing stream, which has been treated in accordance with this invention, contains only minor sulfur and other impurities, the catalytic hydrotreating operation as described above may be omitted, and at least one fraction of said hydrocarbon-containing product stream can be fed directly to a catalytic cracker and treated so as to convert at least a portion of said fraction to hydrocarbons of lower molecular weight and lower boiling point (preferably gasoline and diesel fuel).

The following examples are presented to further illustrate this invention without unduly limitation the scope of this invention.

EXAMPLE I

This example illustrates the experimental procedure for hydrovisbreaking a heavy oil with a mixture of $H_2$ and $H_2S$ in the presence of olefin polymers. A stirred autoclave of 300 cc capacity was charged with about 75–125 grams of a Hondo 650+ residuum, which had an $API_{60}$ gravity of about 6.7 and contained 55–59 weight-% of a fraction boling above 1000° F. ("heavies"), about 11.8 weight-% Ramsbottom carbon residue (determined by ASTM D524), about 135 ppm (parts per million by weight) nickel and about 289 ppm vanadium (both determined by plasma emission analysis), about 6.1 weight-% sulfur (determined by X-ray fluorescence spectrometry) and about 0.94 weight-% nitrogen (determined by ASTM D3228). In invention runs, 10–25 grams of solid, resinous olefin polymers (polypropylene and polystyrene, respectively) were also charged to the reactor which was purged with hydrogen by repeated pressuring and venting.

The reactor was pressured at room temperature to 200 psig with hydrogen sulfide and then to 1000 psig with hydrogen gas and then heated to the desired reaction temperature of 400° C. The initial pressure rose during this heating period to a reaction pressure of about 2000–2500 psig. The reaction mixture was heated at 400° C. for 2 hours with stirring.

The reactor was then allowed to cool to room temperature and was slowly vented. The reactor contents were diluted with some cyclohexane and removed; the reactor was rinsed with cyclohexane, and the entire mixture of reactor contents and diluent (cyclohexane) was filtered. The filtrate was heated under vacuum conditions so as to remove the diluent. The dry filter cake (referred to as solid product) and the diluent-free liquid (oil) product were weighed and analyzed. The solid product was comprised primarily of coke and metal compounds. Pertinent test results are summarized in Table I.

TABLE I

| Run | Added Polymer | Polymer to Oil Wt. Ratio | Reaction Press.[1] (psig) | Liquid Product Yield (Wt %)[2] | Liquid Product Properties | | | | | | |
|---|---|---|---|---|---|---|---|---|---|---|---|
| | | | | | $API_{60}$ | Wt % Con. C[3] | ppm Ni | ppm V | Vol % Heavies[4] | Wt % S | Wt % N |
| Feed | — | — | — | — | 6.7 | — | 135 | 289 | ~57 | 6.1 | 0.94 |
| 1 | None | 0 | 1950–2150 | 78 | 16.9 | 8.6 | 42 | 78 | 29 | 4.0 | 0.74 |
| 2 | Polypropylene[5] | 1:10.0 | 1800–2050 | 88 | 21.0 | 9.1 | 55 | 132 | 23 | 3.6 | 0.75 |
| 3 | Polypropylene[5] | 1:4.0 | 2300–2550 | 76 | 26.1 | 7.2 | 36 | 81 | 16 | 2.9 | 0.68 |

TABLE I-continued

| Run | Added Polymer | Polymer to Oil Wt. Ratio | Reaction Press.[1] (psig) | Liquid Product Yield (Wt %)[2] | Liquid Product Properties | | | | | | |
|---|---|---|---|---|---|---|---|---|---|---|---|
| | | | | | $API_{60}$ | Wt % Con. C[3] | ppm Ni | ppm V | Vol % Heavies[4] | Wt % S | Wt % N |
| 4 | Polystyrene[6] | 1:9.4 | 1900–1975 | 83 | 18.5 | 9.8 | 31 | 54 | 10 | 2.7 | 0.65 |

[1]During the reaction (400° C., 2 hours), the pressure usually increased from the lower value to the higher value of the listed ranges.
[2]Weight percent of entire feed, i.e., weight percent of oil in Run 1, and weight percent of mixture of oil and polymer in Runs 2–4.
[3]Conradson carbon residue (determined according to ASTM D189)
[4]Boiling above 1000° F. (at about 15 psia)
[5]Prepared by R & D, Phillips Petroleum Company, OK; a propylene homopolymer having a melt flow (ASTM D1238) of 12 grams per 10 minutes.
[6]Weight average molecular weight Mw:252,000; number average molecular weight Mn:114,000; marketed under product designation 777 by Monsanto, St. Louis, MO.

Data in Table I clearly show the advantages of the presence of either polypropylene or polystyrene during hydrovisbreaking with a $H_2/H_2S$ mixture: significantly higher API gravity, significantly lower heavies content and slightly lower sulfur content of the product (compare control run 1 with invention runs 2–4).

Data in Table I also show that polystyrene was more effective than polypropylene, at comparable polymer:oil weight ratio, in reducing the concentrations of nickel, vanadium, sulfur and nitrogen, and in reducing the volume percentage of heavies (compare runs 2 and 4). Therefore, polystyrene is presently preferred over polypropylene in the process of this invention.

Reasonable variations and modifications can be made in this invention without departing from the spirit and scope thereof.

I claim:

1. A process for increasing the API gravity of hydrocarbon-containing feed streams comprising the step of contacting (a) a substantially liquid hydrocarbon-containing feed stream, which comprises hydrocarbons boiling above 1,000° F. at about 1 atm, substantially simultaneously with (b) free hydrogen, (c) hydrogen sulfide, and (d) at least one polymer, which is solid at about 25° C. and 1 atm, selected from the group consisting of homopolymers and copolymers of olefinic monomers, substantially in the absence of a solid, inorganic cracking catalyst and substantially in the absence of a solid, inorganic hydroconversion catalyst promoted with metals or compounds of metals, under such contacting conditions as to obtain a product stream having higher $API_{60}$ gravity and lower content of hydrocarbons boiling above 1,000° F. at about 1 atm than said hydrocarbon-containing feed stream;

wherein the general formula of said olefinic monomers is

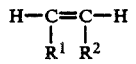

with $R^1$ being selected from the group consisting of H, alkyl groups having from 1 to 6 carbon atoms, alkenyl groups having from 2 to 6 carbon atoms, cycloalkyl groups having from 5 to 10 carbon atoms, aryl groups having from 6 to 12 carbon atoms, the —OH group, —$OR^3$ groups with $R^3$ being an alkyl radical having from 1–3 carbon atoms, the —COOH group, the —$COOR^3$ group with $R^3$ as defined above, the —CN group and the —$CONH_2$ group, and $R^2$ being selected from the same group as $R^1$ except that H is not included.

2. A process in accordance with claim 1, wherein said substantially liquid hydrocarbon-containing feed stream has $API_{60}$ gravity in the range of from about 1 to about 30, and a content of hydrocarbons boiling above 1,000° F. at about 1 atm in the range of from about 1 to about 100 weight-%.

3. A process in accordance with claim 1, wherein said substantially liquid hydrocarbon-containing feed stream has $API_{60}$ gravity in the range of from about 4 to about 20, and a content of hydrocarbons boiling above 1,000° F. at about 1 atm in the range of from about 20 to about 90 weight-%.

4. A process in accordance with claim 1, wherein said substantially liquid hydrocarbon-containing feed stream contains about 0.2 to about 12 weight-% sulfur and from about 0.1 to about 3 weight-% nitrogen.

5. A process in accordance with claim 1, wherein said substantially liquid hydrocarbon-containing feed stream contains about 5 to about 2,000 ppm vanadium and about 3 to about 1,000 ppm nickel.

6. A process in accordance with claim 1, wherein said substantially liquid hydrocarbon-containing feed stream contains about 1–6 weight-% sulfur, about 10–1,000 ppm vanadium and about 5–500 ppm nickel.

7. A process in accordance with claim 1, wherein the volume ratio of (b) free hydrogen to (c) hydrogen sulfide is in the range of from about 0.01 to about 200:1.

8. A process in accordance with claim 1, wherein the volume ratio of (b) free hydrogen to (c) hydrogen sulfide is in the range of from about 0.5:1 to about 10:1.

9. A process in accordance with claim 1, wherein said at least one polymer (d) is selected from the group consisting of homopolymers and copolymers of propylene, homopolymers and copolymers of 2-methylpropylene, homopolymers and copolymers of 2-methyl-1-butene, homopolymers and copolymers of 2-methyl-2-butene, homopolymers and copolymers of 2-methyl-1-pentene, homopolymers and copolymers of 2-methyl-2-pentene, homopolymers and copolymers of 3-methyl-2-pentene, homopolymers and copolymers of 1,3-butadiene, homopolymers and copolymers of isoprene, homopolymers and copolymers of styrene, homopolymers and copolymers of alpha-methylstyrene, homopolymers and copolymers of divinylbenzene, homopolymers and copolymers of tolylethylene, homopolymers and copolymers of acrylic acid and esters thereof, homopolymers and copolymers of methacrylic acid and esters thereof, homopolymers and copolymers of vinylalcohol, homopolymers and copolymers of vinylethers, homopolymers and copolymers of acrylonitrile, and homopolymers and copolymers of acrylamide and methacrylamide.

10. A process in accordance with claim 1, wherein said at least one polymer (d) is selected from the group consisting of homo- and copolymers of propylene and homo- and copolymers of styrene.

11. A process in accordance with claim 1, wherein said at least one polymer (c) is normally solid polypropylene.

12. A process in accordance with claim 1, wherein said at least one polymer (d) is normally solid polystyrene.

13. A process in accordance with claim 1, wherein the weight ratio of said at least one polymer (d) to said substantially liquid hydrocarbon-containing feed stream (a) is in the range of from about 0.01:1 to about 5:1.

14. A process in accordance with claim 1, wherein the weight ratio of said at least one polymer (d) to said substantially liquid hydrocarbon-containing feed stream (a) is in the range of from about 0.02:1 to about 1:1.

15. A process in accordance with claim 1, wherein said at least one polymer (d) is selected from the group consisting of normally solid polypropylene and normally solid polystyrene, and the weight ratio of said at least one polymer (d) to said substantailly liquid hydrocarbon-containing feed stream (a) is in the range of from about 0.05:1 to about 0.5:1.

16. A process in accordance with claim 1, wherein said contacting conditions comprise a reaction temperature in the range of from about 250° C. to about 550° C., a reaction pressure in the range of from about 100 psig to about 10,000 psig and a reaction time in the range of from about 1 minute to about 30 hours.

17. A process in accordance with claim 1, wherein said contacting conditions comprise a reaction temperature in the range of from about 350° to about 450° C., a reaction pressure in the range of from about 400 psig to about 5,000 psig, and a reaction time in the range of from about 0.5 to about 10 hours.

18. A process in accordance with claim 1, wherein said substantially liquid hydrocarbon-containing feed stream contains coke precursors and compounds of nickel and vanadium, which during said contacting are at least partially converted to a coke- and metal-containing precipitate being dispersed in said product stream.

19. A process in accordance with claim 18, wherein said coke- and metal-containing precipitate is separated from said product stream.

20. A process in accordance with claim 19, wherein said coke- and metal-containing precipitated is separated from said product stream by filtration.

* * * * *